US005348125A

United States Patent [19]

Stribling

[11] Patent Number: 5,348,125

[45] Date of Patent: Sep. 20, 1994

[54] SELF-CONTAINED HYDRAULIC POWER UNIT FOR WASTE COMPACTOR CONTAINERS

[75] Inventor: Robert Stribling, Monroe, Ga.

[73] Assignee: Stribling Systems, Inc., Stone Mountain, Ga.

[21] Appl. No.: 23,126

[22] Filed: Feb. 26, 1993

[51] Int. Cl.[5] ..... B30B 15/16; B65F 3/14

[52] U.S. Cl. ..... 191/12.2 R; 100/229 A

[58] Field of Search ..... 414/525.1, 525.9; 191/12.2 R, 12.4, 12.2 A; 100/229 A, 240, 269 R

[56] References Cited

U.S. PATENT DOCUMENTS

| | | | |
|---|---|---|---|
| 2,996,584 | 8/1961 | Roark | 191/12.2 R |
| 3,230,868 | 1/1966 | Smith | 100/229 A |
| 3,250,414 | 5/1966 | Pio | 100/229 A |
| 3,554,120 | 1/1971 | Liberman et al. | 100/229 A |
| 3,575,103 | 4/1971 | Charles | 100/229 A |
| 3,613,569 | 10/1971 | Liberman et al. | 100/229 A |
| 3,625,140 | 12/1971 | Glanz | 100/229 A X |
| 3,680,478 | 8/1972 | Beachner, Jr. et al. | 100/229 A |
| 3,880,072 | 4/1975 | Ord | 100/229 A X |
| 3,881,407 | 5/1975 | Goar | 100/229 A X |
| 4,154,324 | 5/1979 | Upton et al. | 191/12.2 R |
| 4,489,223 | 12/1984 | Puckett et al. | 191/12.2 R |
| 4,996,918 | 3/1991 | Carter et al. | 100/229 A X |

*Primary Examiner*—Michael S. Huppert
*Assistant Examiner*—Scott L. Lowe
*Attorney, Agent, or Firm*—Randy W. Lacasse

[57] ABSTRACT

A portable hydraulic device for supplying hydraulic power to a portable waste container having a self-contained hydraulic compactor system, and a method of using such to provide for efficient waste management. The portable hydraulic device is connected to a source of electrical power, preferably a vehicle battery, by jumper cables located on an extendable/retractable reel located within the portable hydraulic device. A mechanism in the portable hydraulic device converts the electrical power to hydraulic power. The hydraulic power is then transferred to the portable waste compactor through a plurality of hydraulic hoses. As the hydraulic device is portable, the unit may be transported to a plurality of portable waste containers in succession. Compacting the waste product contained within the waste containers extends the period in which the individual containers must be removed and emptied, therefore saving both time and money. The portable device may also be removably/permanently attached to the compaction unit.

11 Claims, 3 Drawing Sheets

SELF-CONTAINED HYDRAULIC POWER UNIT FOR WASTE COMPACTOR CONTAINERS

BACKGROUND OF THE INVENTION

1. Field of the Invention

The present invention relates to electro-hydraulic conversion systems, and more particularly to providing hydraulic power to waste compaction systems.

2. Description of the Prior Art

Hydraulic compactors are frequently used in the collection and disposal of waste. The classic example of such a hydraulic waste compactor is a waste removal truck such as is found in U.S. Pat. No. 3,941,263 to Clucker et al., entitled "Method for Controlling the Packer Blade of a Refuse Truck." Such trucks typically use the truck engine as the source of power to drive the hydraulics of the waste compactor. Other prior art devices of this type are demonstrated by U.S. Pat. No. 3,802,585 to Churchman, entitled "Compactor for Refuse or Other Compressible Material," and U.S. Pat. No. 5,015,144 to Smith et al., entitled "Apparatus for Loading Material Into a Storage Compartment and Associated Fluid Pressure Delivery System." Again, these systems utilize the truck as the source of power for the hydraulics, and the container for holding waste is not separable from the truck.

Another apparatus frequently used in removal of waste is onsite waste containers. The waste containers are either periodically emptied by the prior art trucks as discussed above, or are removed as a unit, and taken to the waste disposal site. The problem with these prior art systems is that each suffers from the frequency with which the trucks must tend to the waste container. The sheer volume of waste which has not been compacted can result in requiring the disposal truck to frequently visit the site where the trash container is located, or the requirement of numerous containers. Either alternative is costly.

Compacting-type waste disposal dumpsters are becoming increasingly popular in waste management because such compacting dumpsters can compact waste into a smaller volume prior to pick-up and disposal. As shown in FIG. 1, prior art units or "compactor containers" typically include a large storage bin or container 8, a hopper 9 generally mounted at one end of the container, and a hydraulically-actuated compactor 11. The compactor 11 powers a compressing ram 14 that compresses waste placed into the hopper 9 and forces the compacted waste into the container 8.

In most applications, power for the hydraulic compactor 11 is provided from a source associated with a building or other permanent facility, such as a power unit 13 comprising a 220 VAC-powered hydraulic compressor. Hydraulic hoses with quick connect/disconnect fittings 12 are used to connect pressurized hydraulic fluid to the compactor 11. When the bin 8 is full, the compactor 11 is disconnected from the hydraulic source and the whole container 8 including hopper 9 and compactor 11 is transported by truck to a waste disposal site. In an alternate method, the container is disconnected from the compactor and then transported.

One particular impediment to the use of such waste compactor containers is the difficulty of obtaining power. Many facilities needing waste compaction do not have 220 VAC; alternative power sources may not be readily available. Typical examples include construction sites, rural county dumpster sites and recycling sites.

It is known in the prior art to provide for portable sources of hydraulic power, such as that shown in U.S Pat. No. 4,211,080 to White, entitled "Hydraulic Power Packs." White discloses a gasoline portable hydraulic unit. Having the actual power source on the portable unit, in addition to the apparatus for converting the power from the power source to hydraulic power results in a large, cumbersome portable unit. A system such as demonstrated by White also requires the user to provide hydraulic hoses for connection to the tools.

The preferred embodiment of White demonstrates the use of a petrol engine power source. Such a power source suffers from the large number of mechanical parts, which frequently results in costly breakdowns, and therefore requires regular maintenance and service including tune-ups, replacement of worn parts, replacement of fuels and lubricants.

If a gasoline engine is used for the purpose of trash compaction, a very large engine, like that of the White reference, would be necessary to provide the torque necessary for proper operation. Because of the gasoline used in the engine, the unit could not be permanently attached to the side of a compactor system because when the system was tilted, the gas and oil would leak out of the apparatus during emptying of the container. A gas engine system would also not hold well in the harsh environment associated with waste products, including dust and weather.

SUMMARY OF THE INVENTION

It is an object of the present invention to provide a unique hydraulic power system which overcomes the deficiencies in the prior art.

It is another object of the present invention to provide a new and unique portable hydraulic apparatus for carrying out waste compaction.

It is another object of the present invention to provide a new and unique hydraulic apparatus which can be attached to, or be made an integral part of, a waste compaction system.

It is a further object of the present invention to provide a waste compaction system which overcomes the deficiencies of the prior art.

It is another object of the invention to provide new and useful apparatus and methods of waste compaction.

These objects and advantages are carried out by a system which uses a portable source of hydraulic power to power a hydraulic waste compactor. In particular, the portable hydraulic apparatus may derive DC electrical operating power from an external source such as, for example, a car battery and its respective electrical system. This electrical power is then converted by use of an electric motor to hydraulic power. The portable hydraulic apparatus may also contain electrical and hydraulic conduits which can be extended from, or retracted into, the unit.

In an alternative embodiment, the hydraulic power unit is removably or permanently attached to a waste compaction system.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It is to be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

It should be kept in mind that the term "waste" should be considered broadly to include, but not be limited to, material to be recycled, liquid, and in general, any materials requiring disposal. Moreover, the invention may be considered useful in other fields where compression of materials is necessary.

Figure 1:
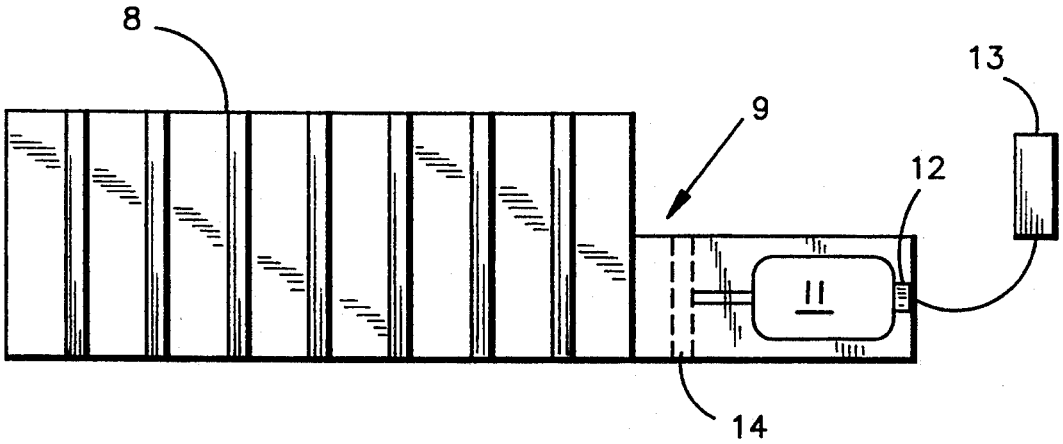
FIG. 1 (PRIOR ART)
FIG. 1 is a prior art device demonstrating a hydraulic waste container.
Figure 2:
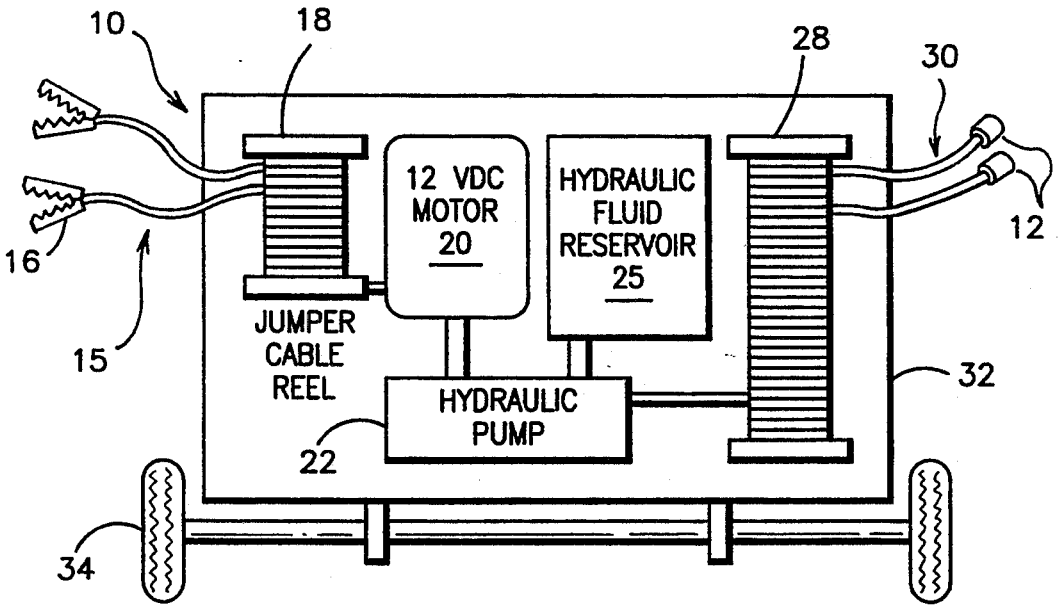
FIG. 2 details the preferred embodiment of the present invention showing the portable hydraulic system with external electric and hydraulic connectors.

As shown in FIG. 2, the present invention provides a portable and self-contained 12 volt DC (VDC) portable hydraulic apparatus 10 for compactor containers. While the preferred embodiment is shown using 12 VDC, other equivalent power sources are contemplated, including other DC voltages. The portable hydraulic apparatus 10 is operative to connect to the 12 volt battery terminals (not shown) of an automobile (not shown) via a pair of jumper cables 15 that include clamps 16 for clamping onto the terminals. An internal jumper cable reel 18 allows the jumper cables 15 to be extended or retracted as desired. The storage could also be implemented by other known apparatuses which are capable of extending and retracting the cables. In addition, the electrical connection could also be a plug-type system, or any suitable electrical connection necessary for the type of DC power available at the site.

Electrical power from the automotive battery is provided to a 12 volt DC motor 20 (connection not shown) that powers hydraulic pump 22. Advantageously, the vehicle-to-hydraulic apparatus connection may have an indicator light for indicating that the connection is complete. Battery power can also be derived from an on-board battery 39. In the preferred embodiment the on-board battery is electrically connected in parallel with the external battery to reduce the amperage requirements of the external system. It helps to maintain the voltage at 12 Volts during heavy use.

The electric motor could be of any type suitable for taking DC power and driving the hydraulic system. For example, the motor could be a 12 VDC motor operating at 3350–3600 RPM, having amperage of 170–200 amps. A typical duty cycle would be 60%+.

The hydraulic pump 22 receives fluid from a hydraulic fluid reservoir 25 and provides pressurized hydraulic fluid to one or more hydraulic hoses 30, including quick connect/disconnect fittings 12 located at the distal end of said hoses. An internal hose reel 28 allows the hydraulic hoses to be extended or retracted as desired.

The entire portable hydraulic apparatus 10 may be enclosed within a housing 32 and mounted on wheels 34 for portability. The housing for the portable device can be any conventional housing, providing support and protection from the elements.

Alternatively, in a secondary embodiment (FIG. 3*b*) the unit may be removably or permanently mounted on the compaction unit itself. The hydraulic power unit in a third embodiment (not shown) can further be made to be an integral part of the compaction system, residing inside the compactor housing 9.

The conversion of electrical energy to hydraulic energy can be carried out by any well-known conversion device.

To use the portable hydraulic apparatus 10, a suitable automobile or truck is driven to the site where a compactor container 8 is present and compaction is needed. The hydraulic hoses 30 are connected to the compactor 11 through connectors 12. The jumper cables 15 or plug system (not shown) are connected to the battery of the vehicle, and the vehicle is left running to generate 12 VDC. The compactor then compresses the waste contained in the bin 9. Upon completion of compaction, the portable hydraulic apparatus 10 may be disconnected and removed from the site. Alternatively, the device could be left attached to the compaction device.

Figure 3A:
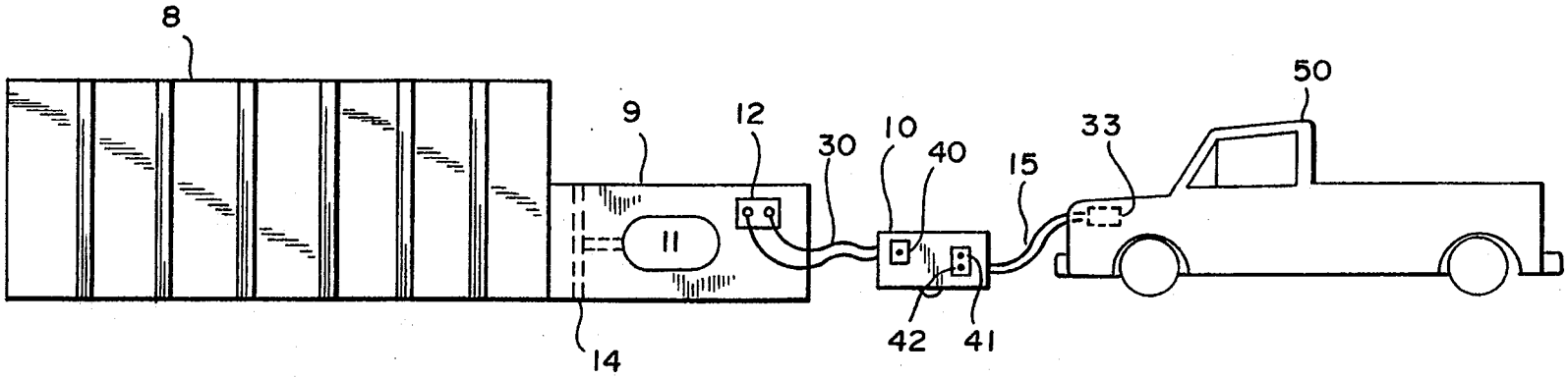
FIG. 3*a* details the use of the portable hydraulic apparatus deriving power from a vehicle battery, and powering the prior art device of FIG. 1.

FIG. 3*a* shows the preferred embodiment which demonstrates a portable hydraulic apparatus 10 of the instant invention. In FIG. 3*a*, the portable hydraulic apparatus 10 is connected to an external power source, which is shown as a vehicle 50. The portable hydraulic apparatus 10 may also derive power from a variety of other sources, which may or may not be stationary. In this instance, the vehicle provides 12 VDC from the vehicle battery 33 to the portable hydraulic apparatus 10 via electrical conduit 15.

The remaining portion of FIG. 3*a* comprising hoses 30, and the components of the prior art device 8 as previously described above.

The system allows for draws of high amperage from a vehicle or extra batteries. From this, two or more horsepower can be maintained for long periods of time.

Figure 3B:
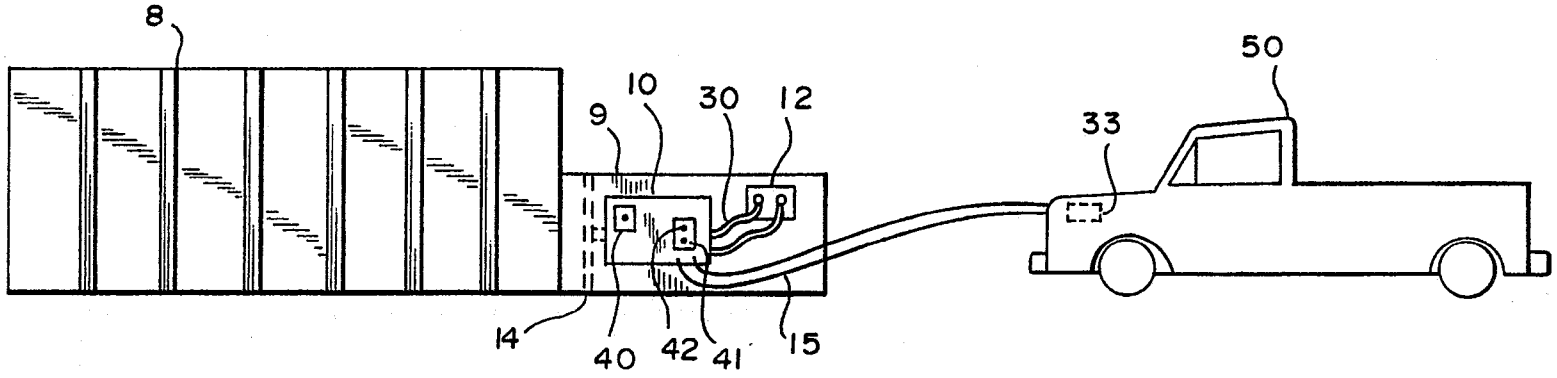
FIG. 3*b* details the use of the hydraulic apparatus deriving power from a vehicle battery, and attached to and powering the prior art device of FIG. 1.

FIG. 3*b* details a second embodiment wherein the hydraulic apparatus 10 is either attached to, or made an integral part of, the waste compaction device 9. The attachment can be made by any known means for attaching devices to each other. For example, the device could be bolted onto the waste compaction device, or a system of brackets or tongue-and-groove combinations could be made to removably mount the system onto a plurality of waste compaction devices.

It is further contemplated that the hydraulic apparatus could be attached to, or made an integral part of, another hydraulically actuated device other than a waste compacting device.

Figure 4:
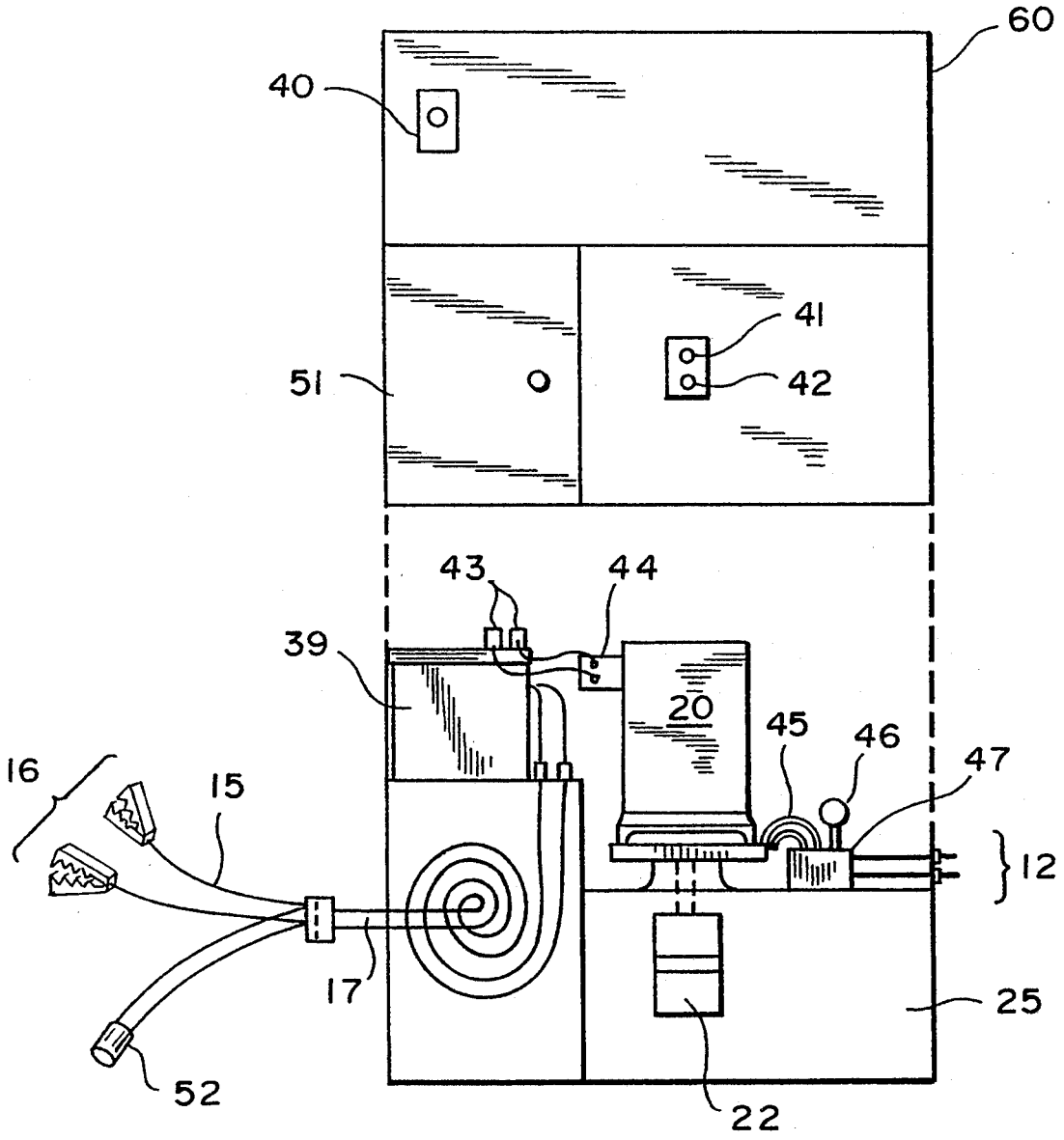
FIG. 4 shows particular features of a preferred embodiment of the portable hydraulic apparatus of the instant invention.

FIG. 4 shows an internal view of the hydraulic apparatus with the external cover 60 removed upward. The portable hydraulic apparatus 10 has a plurality of switches and/or buttons which are used for controlling the apparatus. FIG. 4 shows a starter switch 41 and kill switch 42. In addition to these controls an indicator light may be used to indicate that the on-board battery is adequately charged so that the external power supply may be disconnected. Electrical controls monitor the on-board battery 39, if present, to ensure that the on-board battery is always left with a charge.

FIG. 4 also shows an electrical cable storage door 51 for storing the cables 15 or 17, or an extra set of cables. The cables 17 are demonstrated here as being connected to both clamps 16 and a plug connector 52. Connectors 43 are for connecting the positive and negative leads of the battery to solenoid 44. The electrical energy from the battery 39 powers 12 VDC motor 20, which drives hydraulic pump 22. The pressure and tank lines 45 are connected to a DC double active valve 47, which has a pressure valve 46 attached thereto. The hydraulic fluid is provided by reservoir 25. The system uses quick connect/disconnect fittings 12 to connect to another device.

While various preferred embodiments have been shown and described, it will be understood that there is no intent to limit the invention by such disclosure, but rather, is intended to cover all modifications and alternate constructions falling within the spirit and scope of the invention as defined in the appended claims.

For instance, the invention is not limited to any particular power requirements within, into, or out of the device. Nor is it limited by any precise physical configuration including size, shape or overall design. Furthermore, the device may be portable by other known methods.

I claim:

1. An apparatus for providing hydraulic power to plural portable waste compaction containers comprising:

a portable hydraulic system;

means for providing external DC electrical power to said portable hydraulic system;

means for providing internal DC electrical power to said portable hydraulic system in parallel with said means for providing external DC electrical power;

means for converting said electrical power to hydraulic power, and means for transferring said hydraulic power from said portable hydraulic system to a waste compaction container.

2. The portable apparatus as per claim 1, wherein said means for providing internal DC electrical power is a battery.

3. The portable apparatus as per claim 1, wherein said means for providing external DC electrical power is a vehicle battery.

4. A portable apparatus for providing hydraulic power to a waste management system comprising:

an electrical attachment connected to a length of electrical conduit;

first extending and retracting means for adjusting the length of said electrical conduit;

said electrical attachment means connectable to an external power source;

conversion means for converting power derived from said external power source to hydraulic energy;

second extending and retracting means for adjusting a length of hydraulic conduit;

hydraulic attachment means connecting said length of hydraulic conduit to a waste compacting means, and whereby said hydraulic attachment means provides hydraulic energy for operation of said waste compacting means.

5. The portable apparatus as per claim 4, wherein said waste compacting means is portable.

6. The portable apparatus as per claim 4, wherein said conversion means further comprises an electric motor and hydraulic pump and reservoir.

7. The portable apparatus as per claim 4, wherein said power source is a vehicle battery.

8. The portable apparatus as per claim 4, wherein said electrical attachment means comprises at least one clamping means.

9. The portable apparatus as per claim 4, wherein said first or second extending and retracting means comprise at least a coiling means.

10. A waste compaction system comprising:

a portable waste compaction unit including a compactor and a waste receptacle;

a hydraulic compaction system;

a hydraulic power system operatively connected to said portable waste compaction unit comprising;

an internal DC power source;

an electro-hydraulic conversion means including a DC electrical motor means, a hydraulic pumping means and a hydraulic reservoir for converting said DC electrical power to hydraulic power;

electrical connector means for connecting external DC electrical power to said hydraulic power system; and, hydraulic connector means for connecting said hydraulic power system to said portable waste compaction unit.

11. The waste compaction system as per claim 10, further comprising a DC valve for varying the pressure of the output of said hydraulic power system.

* * * * *